US010308453B2

(12) United States Patent
Inoue

(10) Patent No.: US 10,308,453 B2
(45) Date of Patent: Jun. 4, 2019

(54) SHEET FEEDING APPARATUS AND IMAGE FORMING APPARATUS

(71) Applicant: CANON KABUSHIKI KAISHA, Tokyo (JP)

(72) Inventor: Kozo Inoue, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/837,503

(22) Filed: Dec. 11, 2017

(65) Prior Publication Data

US 2018/0179004 A1 Jun. 28, 2018

(30) Foreign Application Priority Data

Dec. 22, 2016 (JP) ..... 2016-250093
Oct. 27, 2017 (JP) ..... 2017-208373

(51) Int. Cl.

| | |
|---|---|
| ***B65H 3/06*** | (2006.01) |
| ***B65H 1/04*** | (2006.01) |
| ***G03G 15/00*** | (2006.01) |
| ***B65H 1/26*** | (2006.01) |

(52) U.S. Cl.

CPC ..... *B65H 3/0684* (2013.01); *B65H 1/04* (2013.01); *B65H 1/266* (2013.01); *G03G 15/6511* (2013.01); *B65H 2801/03* (2013.01); *B65H 2801/06* (2013.01)

(58) Field of Classification Search

CPC .. B65H 3/0607; B65H 3/0669; B65H 3/0684; B65H 1/04; B65H 1/26; B65H 1/266
USPC ..... 271/114, 117, 118
See application file for complete search history.

(56) References Cited

U.S. PATENT DOCUMENTS

| | | | | |
|---|---|---|---|---|
| 7,380,787 | B2 * | 6/2008 | Fukumura | H04N 1/00519 271/264 |
| 7,568,693 | B2 * | 8/2009 | Izuchi | B65H 1/04 271/117 |
| 7,891,656 | B1 * | 2/2011 | Hsu | B65H 3/0684 271/117 |
| 8,459,635 | B2 | 6/2013 | Inoue | |

(Continued)

FOREIGN PATENT DOCUMENTS

| | | | |
|---|---|---|---|
| JP | 5-17033 | * | 1/1993 |
| JP | 2001122452 | A | 5/2001 |

(Continued)

OTHER PUBLICATIONS

European Search Report dated Jun. 5, 2018, in related European Patent Application No. 17204395.2.

*Primary Examiner* — Thomas A Morrison
(74) *Attorney, Agent, or Firm* — Venable LLP

(57) ABSTRACT

A sheet feeding apparatus includes a sheet supporting portion to support a sheet, a feeding portion to feed the sheet, a swing unit to swingably support the feeding portion between a feed position and a separation position, a swing shaft to swingably support the swing unit, an urging portion to urge the swing unit toward the feed position, and a holding portion to hold the swing unit at the separation position against an urging force of the urging portion. The swing unit includes first and second bearing portions to slidingly support the swing shaft, a metal member to hold the first and second bearing portions, and a resin member including a guide surface to guide the sheet fed by the feeding portion.

19 Claims, 11 Drawing Sheets

(56) References Cited

U.S. PATENT DOCUMENTS

| | | | | |
|---|---|---|---|---|
| 9,272,861 | B2 | 3/2016 | Tateishi et al. | |
| 2006/0071399 | A1* | 4/2006 | Asada | B65H 3/0684 271/117 |
| 2013/0341851 | A1 | 12/2013 | Mitamura | |
| 2015/0344246 | A1 | 12/2015 | Zensai | |

FOREIGN PATENT DOCUMENTS

| | | | |
|---|---|---|---|
| JP | 2003072985 | A | 3/2003 |
| JP | 2015086071 | A | 5/2015 |

* cited by examiner

SHEET FEEDING APPARATUS AND IMAGE FORMING APPARATUS

BACKGROUND OF THE INVENTION

Field of the Invention

The present invention relates to a sheet feeding apparatus for feeding sheets and an image forming apparatus including the sheet feeding apparatus.

Description of the Related Art

In general, image forming apparatuses, such as copying machines and printers, include a feed cassette which stores sheets to be fed to an image forming portion, and which is inserted to and drawn from an image forming apparatus body (hereinafter referred to as an apparatus body). In these image forming apparatuses, when the feed cassette is attached, a feed roller moves down to a feed position to feed the sheets, and abuts against a sheet in the feed cassette. The feed roller then rotates in a sheet feed direction in accordance with a feed signal, and thereby sends the sheets of the feed cassette downstream, sequentially from an uppermost one of the sheets.

Conventionally, Japanese Patent Laid-Open No. 2015-086071 proposes an image forming apparatus in which a feed roller is supported by a supporting member. The supporting member is urged downward by a feed pressure spring. Thereby the feed roller abuts against a sheet in the feed cassette at a predetermined nip pressure. The supporting member moves up when the feed cassette is drawn, and is held by a holding member in a state where the feed roller is positioned at a standby position. The standby position of the feed roller is set so that the feed roller does not interfere with the feed cassette and the sheets stacked in the feed cassette while the feed cassette is drawn. The holding member is disposed out of a conveyance area, whereas the feed roller and the feed pressure spring are disposed at a substantially center portion of the conveyance area in a sheet width direction.

However, the supporting member described in Japanese Patent Laid-Open No. 2015-086071 receives forces from directions opposite to each other by the holding member and the feed pressure spring, when the supporting member is held in a state where the holding member resists the urging force of the feed pressure spring and holds the feed roller at the standby position. That is, in the supporting member, torsional stress occurs in a portion between the holding member and the feed pressure spring. In a case where the supporting member is formed of, for example, a resin member having a relatively low stiffness, the above-described torsional stress promotes creep deformation of the supporting member, and thus causes the feed roller to be positioned lower than the predetermined standby position.

In this case, to prevent the interference between the feed roller and the sheets of the feed cassette caused when the feed cassette is inserted and drawn, a space needs to be secured in consideration of the deformation of the supporting member. This leads to upsizing of the apparatus.

SUMMARY OF THE INVENTION

According to one aspect of the present invention, a sheet feeding apparatus includes a sheet supporting portion configured to support a sheet, a feeding portion configured to feed the sheet supported by the sheet supporting portion, a swing unit configured to swingably support the feeding portion between a feed position and a separation position, the feed position being a position at which the feeding portion abuts against the sheet supported by the sheet supporting portion and feed the sheet, the separation position being a position at which the feeding portion is separated from the sheet supported by the sheet supporting portion, a swing shaft configured to swingably support the swing unit, an urging portion configured to contact with the swing unit at a first position so as to urge the swing unit toward the feed position, and a holding portion configured to contact with the swing unit at a second position so as to hold the swing unit at the separation position against an urging force of the urging portion, the second position being different from the first position in an axial direction of the swing shaft. The swing unit includes a first bearing portion configured to slidingly support the swing shaft, a second bearing portion disposed offset to the first bearing portion and configured to slidingly support the swing shaft, a metal member configured to hold the first bearing portion and the second bearing portion, and a resin member having a guide surface configured to guide the sheet fed by the feeding portion.

Further features of the present invention will become apparent from the following description of exemplary embodiments with reference to the attached drawings.

DESCRIPTION OF THE EMBODIMENTS

First Embodiment

Overall Configuration

Figure 1:
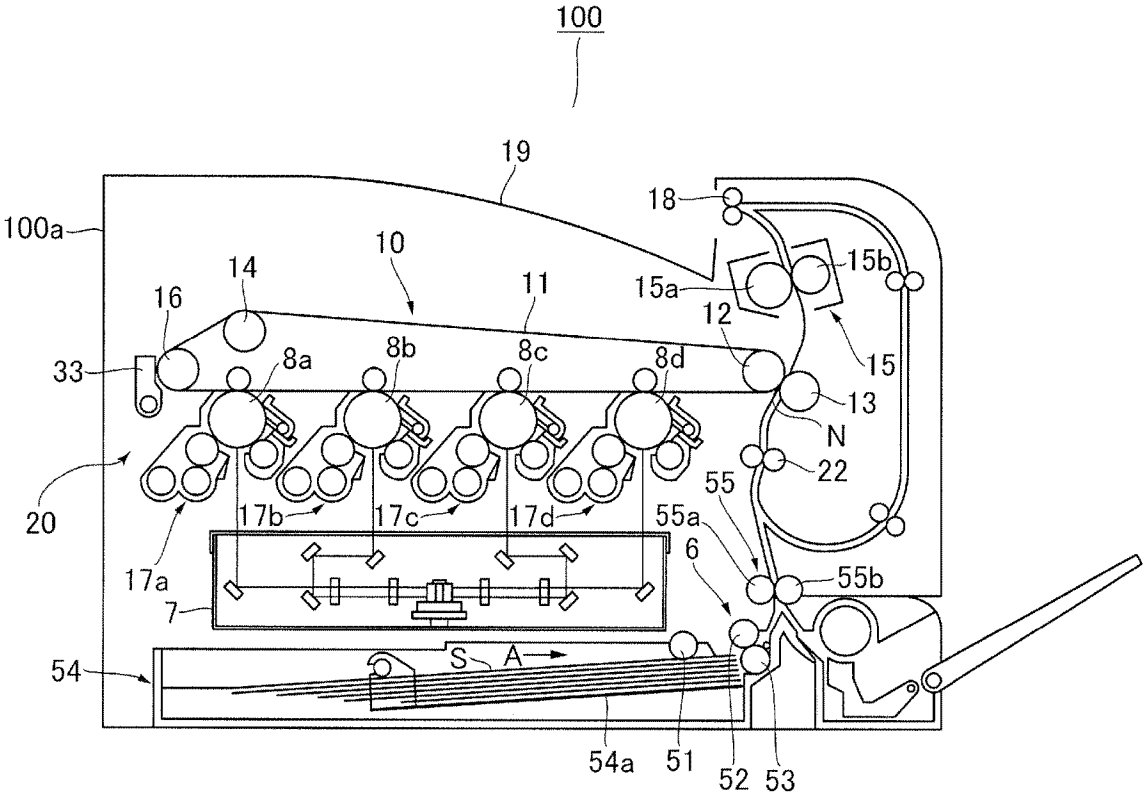
FIG. 1 is an overall schematic diagram of a printer of a first embodiment.

First, a first embodiment of the present invention will be described. A printer 100 of the first embodiment, which serves as an image forming apparatus, is an electrophotographic laser-beam printer. As illustrated in FIG. 1, the printer 100 includes an apparatus body 100*a*, which includes a sheet feeding apparatus 6 and an image forming portion 20. The image forming portion 20 includes an intermediate transfer belt unit 10, an exposure apparatus 7, and process cartridges 17*a* to 17*d*.

The sheet feeding apparatus 6 is provided with a feed cassette 54, which stores sheet S and serves as a drawer portion. The feed cassette 54 holds a sheet-stacking plate 54*a*, on which the sheet S is stacked and which can raise and lower the sheet S. The sheet-stacking plate 54*a* serves as a sheet supporting portion. The process cartridges 17*a* to 17*d* are disposed along an intermediate transfer belt 11 of the intermediate transfer belt unit 10, and include photosensitive drums 8*a*, 8*b*, 8*c*, and 8*d*, respectively.

The process cartridges 17*a* to 17*d* are configured to form toner images of yellow, magenta, cyan, and black, respectively in this order. Each of the photosensitive drums 8*a*, 8*b*, 8*c*, and 8*d* is driven to rotate in a clockwise direction in FIG. 1. The exposure apparatus 7 irradiates the photosensitive drums 8*a*, 8*b*, 8*c*, and 8*d* with laser beams in accordance with image information sent from a read portion (not illustrated) or an external computer (not illustrated).

The photosensitive drums 8*a*, 8*b*, 8*c*, and 8*d* are electrically charged in advance by chargers (not illustrated), and thus the laser beams from the exposure apparatus 7 form electrostatic latent images on the surfaces of the photosensitive drums 8*a*, 8*b*, 8*c*, and 8*d*. The electrostatic latent images on the photosensitive drums 8*a*, 8*b*, 8*c*, and 8*d* are developed into toner images by development portions of the process cartridges, and then the toner images are sequentially transferred onto the intermediate transfer belt such that one toner image is superposed on another. With this operation, four colors of toner image are formed on the intermediate transfer belt 11.

The intermediate transfer belt unit 10 includes the intermediate transfer belt 11, which is wound and stretched around a driving roller 12, a driven roller 14, and a tension roller 16, which are disposed so as to have a predetermined positional relationship. A secondary transfer roller 13 is disposed at a position which faces the driving roller 12. The secondary transfer roller 13 holds the intermediate transfer belt 11 between the secondary transfer roller 13 and the driving roller 12. The secondary transfer roller 13 and the intermediate transfer belt 11 form a transfer nip N, which transfers the toner images onto the sheet.

The sheet feeding apparatus 6 includes a pickup roller 51 which serves as a feeding portion, a feed roller 52, and a retard roller 53 which is in pressure contact with the feed roller 52. The sheet S fed by the pickup roller 51 is sent, one by one, by the feed roller 52 and the retard roller 53, and conveyed to a registration roller pair 22 constituted by conveyance rollers 55*a* and 55*b*. The retard roller 53 is driven by the feed roller 52, when a limit value of a torque limiter is exceeded. The retard roller 53 is applied with a driving force toward a direction opposite to a sheet conveyance direction, but the driving force may not be applied. The sheet S is once stopped at the registration roller pair 22 in a state where the sheet S abuts against a nip of the registration roller pair 22. After that, the sheet S is sent into the transfer nip N at a predetermined timing by the registration roller pair 22.

The transfer nip N is applied with transfer bias via the secondary transfer roller 13, and thereby secondary transfer of the four colors of toner image formed on the intermediate transfer belt is performed on the sheet S, which is sent from the sheet feeding apparatus 6 and conveyed by the registration roller pair 22. In addition, a belt cleaning apparatus 33 is disposed at a position which faces the tension roller 16, so as to abut against the surface of the intermediate transfer belt 11.

Above the transfer nip N, a fixing apparatus 15 is disposed. The fixing apparatus 15 includes a fixing roller 15*a* and a pressure roller 15*b*. The sheet S, onto which the toner images have been transferred, is conveyed to a fixing nip portion between the fixing roller 15*a* and the pressure roller 15*b*, and is heated and pressurized by the fixing roller 15*a* and the pressure roller 15*b*. Thus, the transferred toner images are fixed on the surface of the sheet S. After the toner images are fixed on the sheet S by the fixing apparatus 15, the sheet S is discharged onto a discharge tray 19 via a discharge roller pair 18.

Feed Cassette

Figure 2:
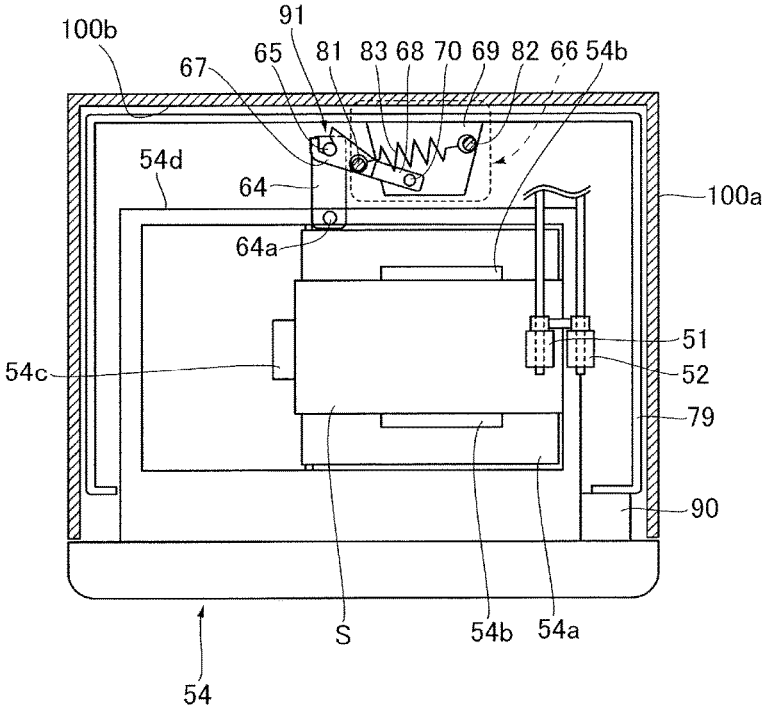
FIG. 2 is a plan view illustrating a feed cassette and a drawing unit.

Next, the feed cassette 54 will be described. As illustrated in FIG. 2, the feed cassette 54 is configured to be attached to and drawn from the apparatus body 100*a*. The feed cassette 54 includes the sheet-stacking plate 54*a* on which the sheet S is stacked, side regulation members 54*b* which regulate side edges of the sheet S stacked on the sheet-stacking plate 54*a*, and a trailing edge regulation member 54*c* which regulates a trailing edge of the sheet S. The feed cassette 54 is supported by guide rails 21 (see FIG. 6B) so that the feed cassette 54 can move between an attachment position and a drawn position. The attachment position is a position for feeding the sheet, and the drawn position is a position to which the feed cassette 54 is drawn out from the attachment position.

The feed cassette 54 is drawn from the apparatus body 100*a* to refill the feed cassette 54 with the sheet. Thus, the feed cassette 54 may be restricted from drawing by a regulation portion (not illustrated), during the drawing, at a position at which the feed cassette 54 can be refilled with the sheet; or may be drawn out of the apparatus body 100*a*. In addition, the feed cassette 54 is configured to be drawn toward a direction perpendicular to the feed direction in which the pickup roller 51 feeds the sheet, that is, toward a frontward direction on the sheet of FIG. 1.

Drawing Unit

As illustrated in FIG. 2, the sheet feeding apparatus 6 is provided with a drawing unit 66, which is configured to draw the feed cassette 54 into the apparatus body 100*a*. On a back-side side wall 54*d* of the feed cassette 54, a swing arm 64 is supported so that the swing arm 64 can swing on a shaft 64*a* which serves as a supporting point. The swing arm 64 has a swing pin 65 at a leading end portion of the swing arm 64. The drawing unit 66 is formed on a back-side inner wall surface 100*b* of the apparatus body 100*a*. The drawing unit 66 includes a drawing unit base 69 and a drawing arm 68. The drawing arm 68 has a drawing hook 67 at a leading end of the drawing arm 68, and is supported so that the drawing arm 68 can pivot on a fulcrum 70 disposed on the drawing unit base 69.

The drawing hook 67 of the drawing arm 68 is provided with a concave portion 91, which locks the swing pin 65 of the swing arm 64. In addition, an arm pin 81 is provided between the drawing hook 67 of the drawing arm 68 and the fulcrum 70; a base pin 82 is provided on the drawing unit base 69; and an extension spring 83 is provided such that one end of the extension spring 83 is locked by the arm pin 81 and the other end is locked by the base pin 82. The extension spring 83 urges the drawing arm 68 so that the drawing arm 68 pivots around the fulcrum 70. The extension spring 83 and the drawing arm 68 form a toggle mechanism, and the urging direction of the drawing arm 68 by the extension spring 83 is changed when the drawing arm 68 is positioned at a predetermined pivot position.

Specifically, in a case where the feed cassette 54 is to be drawn out, while the concave portion 91 locks the swing pin 65, the drawing arm 68 pivots counterclockwise, i.e., drawing direction, around the fulcrum 70 against an urging force of extension spring 83 from a position illustrated in FIG. 2. After that, when the feed cassette 54 is further drawn, the drawing arm 68 pivots until the lock of the swing pin 65 and the concave portion 91 is released. Then, the drawing arm 68 is urged counterclockwise by the extension spring 83, and is positioned at a position at which the swing pin 65 is to be received by a stopper (not illustrated).

When the feed cassette 54 is to be attached to the apparatus body 100*a*, the drawing arm 68 is positioned at a position at which the swing pin 65 of the swing arm 64 is capable of entering the concave portion 91 of the drawing hook 67. Thus, when the feed cassette 54 is inserted into the apparatus body 100*a*, the swing pin 65 enters the concave portion 91 of the drawing hook 67. After this, when the feed cassette 54 is further pushed, the drawing arm 68 is pushed backward against the urging force of the extension spring 83, via the swing pin 65 and the drawing hook 67.

With this operation, the drawing arm 68 pivots clockwise around the fulcrum 70 against the extension spring 83. After pivoting to a predetermined position, an urging force by the extension spring 83 is additionally applied to the drawing arm 68, and thereby the drawing arm 68 pivots clockwise. As a result, the feed cassette 54 is attached to the apparatus body 100*a* by the extension spring 83, via the drawing arm 68.

The feed cassette 54 is provided with a stopper 90. Thus, when the feed cassette 54 is attached to the apparatus body 100*a*, the feed cassette 54 abuts against a body frame 79 of the apparatus body 100*a*, and thereby the feed cassette 54 is positioned with respect to the apparatus body 100*a*. That is, when the feed cassette 54 is drawn into the apparatus body 100*a* by the drawing unit 66, the stopper 90 of the feed cassette 54 abuts against the body frame 79, so that the feed cassette 54 is stopped at the attachment position. With the feed cassette 54 positioned at the attachment position, the sheet can be fed from the feed cassette 54 by the pickup roller 51.

Detailed Configuration of Sheet Feeding Apparatus

Figure 3A:
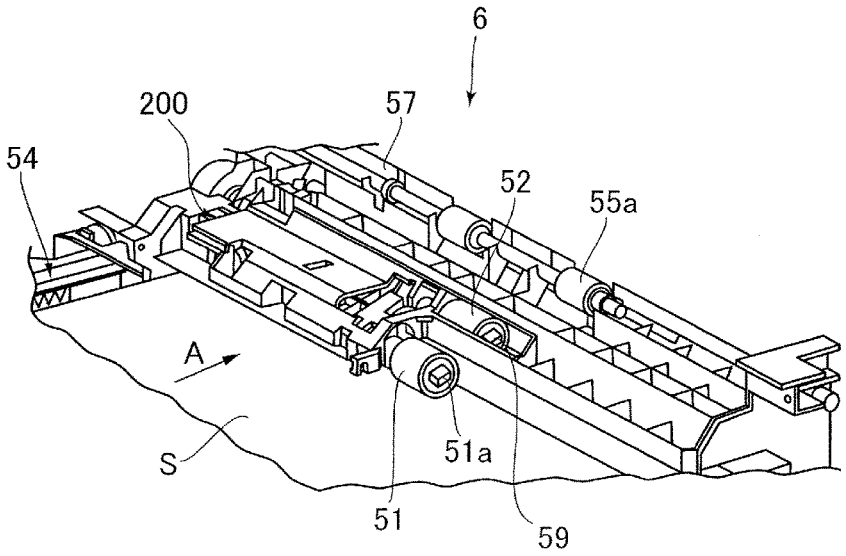
FIG. 3A is a perspective view illustrating a roller support mechanism and each roller.
Figure 4A:
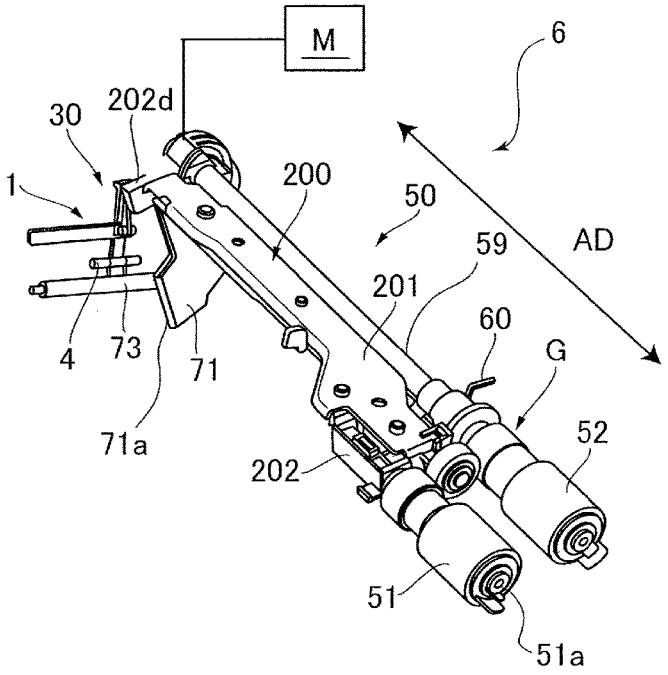
FIG. 4A is a perspective view illustrating the roller support mechanism and a holding mechanism.

Next, a detailed configuration of the sheet feeding apparatus 6 will be described. As illustrated in FIG. 3A, the sheet feeding apparatus 6 includes a feed frame 57, which is fixed on the apparatus body 100*a* (see FIG. 1) and by which the feed roller 52, the retard roller 53, and the conveyance roller 55*a* are supported. Specifically, as illustrated in FIG. 4A, the feed roller 52 is fixed to an end portion of a feed driving shaft 59, which is made of metal and connected to a motor M. The pickup roller 51 is attached to a shaft 51*a* which is rotatably disposed in a roller support mechanism 200. The roller support mechanism 200 is swingably supported by the feed driving shaft 59. The shaft 51*a* is disposed parallel to the feed driving shaft 59. The feed driving shaft 59 and the shaft 51*a* are coupled with each other via a gear train G.

With this configuration, the driving force from the motor M is transmitted to the feed driving shaft 59, and to the shaft 51*a* via the gear train G, so that the pickup roller 51 rotates. The pickup roller 51 abuts against the top face of the sheet S stacked on the sheet-stacking plate 54*a*, and rotates with the rotation of the shaft 51*a*, so that the sheet is sent. With this operation, the pickup roller 51 sends an uppermost sheet downstream in the sheet feed direction (direction indicated by an arrow A in FIG. 3A).

Figure 3B:
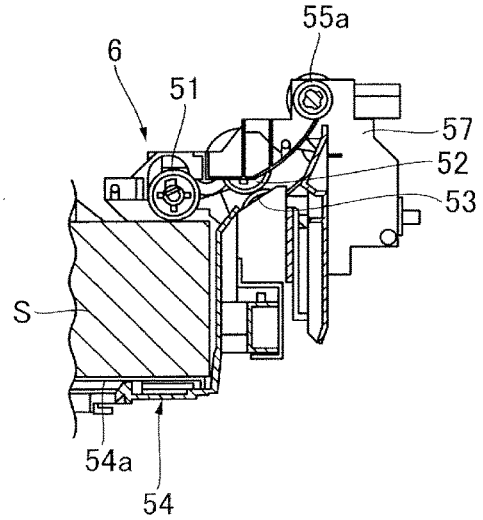
FIG. 3B is a cross-sectional view illustrating a state where a pickup roller abuts against a top face of a sheet.

The pickup roller 51 is configured so that it can move between a feed position and a standby position, depending on the attachment or drawing operation of the feed cassette 54. The feed position is a position at which the pickup roller 51 abuts against the sheet S of the feed cassette 54 and feeds the sheet S (see FIG. 3B). The standby position is a position at which the pickup roller 51 is separated from the sheet S and waits (see FIG. 5A). The pickup roller 51 moves from the feed position to the standby position, with the roller support mechanism 200 being raised. That is, the roller support mechanism 200, which serves as a swing unit, swingably supports the pickup roller 51 between a feed position, at which the pickup roller 51 can feed the sheet, and a separation position at which the pickup roller 51 is separated from the sheet.

As illustrated in FIG. 4A, the sheet feeding apparatus 6 includes a feed pressure spring 60, which serves as an urging portion and a first urging portion. The feed pressure spring 60 urges the roller support mechanism 200 toward the feed position so that the pickup roller 51 is in pressure contact with the top face of the sheet S stacked on the sheet-stacking plate 54*a*. The feed pressure spring 60 is constituted by a torsion coil spring, which loosely fits the feed driving shaft 59. One end of the torsion coil spring is connected to the roller support mechanism 200, and the other end is connected to a frame of the apparatus body 100*a*. The roller support mechanism 200 is swingably supported by the feed driving shaft 59 which serves as a swing shaft, and rotatably supports the shaft 51*a* of the pickup roller 51.

Holding Mechanism

Figure 4B:
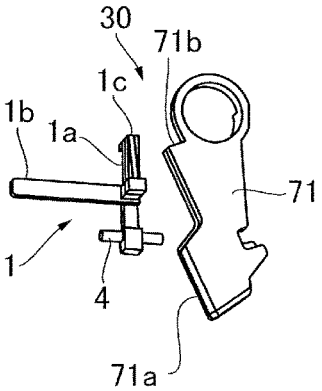
FIG. 4B is a perspective view illustrating a first holding member and a second holding member.
Figure 5A:
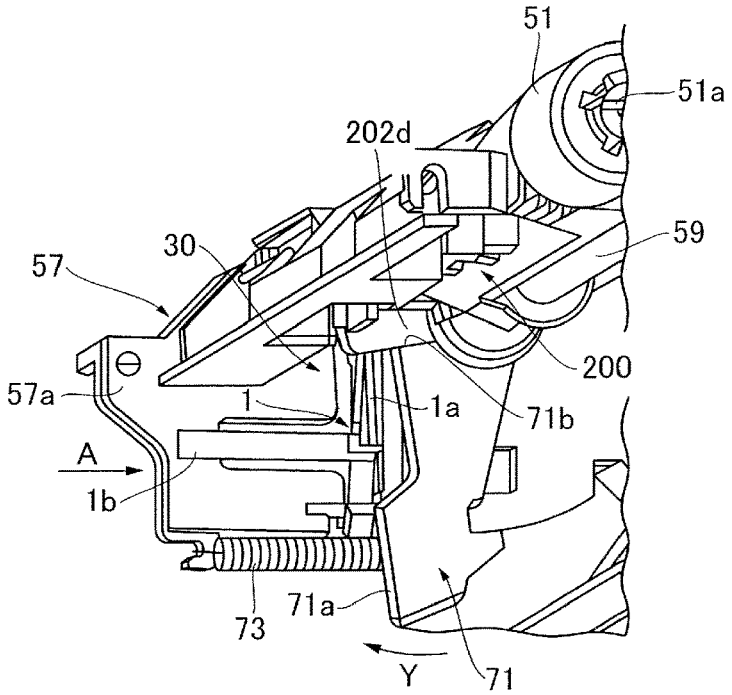
FIG. 5A is a perspective view illustrating the holding mechanism in a state where the pickup roller is positioned at a standby position.

As illustrated in FIGS. 4A and 5A, the sheet feeding apparatus 6 is provided with a holding mechanism 30, which holds the roller support mechanism 200 at the separation position so that the pickup roller 51 is positioned at the standby position. The holding mechanism 30 releases the holding of the roller support mechanism 200 when the feed cassette 54 is attached to the apparatus body. As illustrated in FIG. 4B, the holding mechanism 30 includes a first holding member 71 and a second holding member 1, which can hold the roller support mechanism 200 at the separation position in a state where the feed cassette 54 is positioned at the drawn position. The second holding member 1 is disposed on the back side with respect to the first holding member 71 in an attachment direction of the feed cassette 54. In addition, the first holding member 71 is disposed at a position different from a position of the feed pressure spring 60 in an axial direction AD of the feed driving shaft 59. More specifically, the feed pressure spring 60 contacts with the roller support mechanism 200 at a first position, and the first holding member 71 contacts with the roller support mechanism 200 at a second position different from the first position in the axial direction AD.

The first holding member 71 loosely fits the feed driving shaft 59, and can pivot between a holding position and a non-holding position. The holding position is a position at which the first holding member 71 holds the roller support mechanism 200 at the separation position. The non-holding position is a position at which the first holding member 71 is separated from the roller support mechanism 200 and thus does not hold the roller support mechanism 200. When the first holding member 71 is positioned at the holding position, the pickup roller 51 is held at the standby position. When the first holding member 71 releases the holding of the roller support mechanism 200, the pickup roller 51 can be moved to the feed position by the feed pressure spring 60. Similarly, when the second holding member 1 holds the roller support mechanism 200 at the separation position, the pickup roller is held at the standby position. When the second holding member 1 releases the holding of the roller support mechanism 200, the pickup roller 51 can be moved to the feed position by the feed pressure spring 60.

As illustrated in FIGS. 4A, 4B, and 5A, the first holding member 71, which serves as a holding portion, is formed like a plate, and can pivot between the holding position and the non-holding position, in a direction perpendicular to the attachment direction in which the feed cassette 54 is attached to the apparatus body. In addition, the first holding member 71 is urged toward a direction indicated by an arrow Y in FIG. 5A, by a tension coil spring 73 which is disposed between the first holding member 71 and the feed frame 57 and which serves as a second urging portion. The first holding member 71 has an upper edge portion 71*b* which serves as a pressing portion. In a state where the feed cassette 54 is positioned at the drawn position, the upper edge portion 71*b* abuts against an abutment portion 202*d* of the roller support mechanism 200 from a downward direction, and holds the roller support mechanism 200 at the separation position.

The first holding member 71 also has a pressed portion 71*a* formed in a lower portion of the first holding member 71. When the pressed portion 71*a* is pushed by the feed cassette 54 which is being attached to the apparatus body 100*a*, the first holding member 71 rotates toward a direction opposite to the direction indicated by the arrow Y in FIG. 5A, against the urging force of the tension coil spring 73. With this operation, the upper edge portion 71*b* of the first holding member 71 is separated from the roller support mechanism 200 and releases the holding of the roller support mechanism 200, and thus the pickup roller 51 abuts against the top face of the sheet of the feed cassette 54 at a predetermined feed pressure, due to the urging force of the feed pressure spring 60.

The second holding member 1, which serves as a second holding portion, is configured to pivot with the attachment of the feed cassette 54. Next, a configuration of the second holding member 1 will be described. As illustrated in FIGS. 4B and 5A, the second holding member 1 is constituted by a resin spring which is made from synthetic resin, and is attached to the feed frame 57 so that the second holding member 1 can pivot around a pivot supporting shaft 4. The pivot supporting shaft 4 extends in a direction perpendicular to the insertion-and-removal direction of the feed cassette 54. The second holding member 1 includes a body portion 1*a*, which is disposed so as to extend in a vertical direction, and an arm portion 1*b*, which is formed like an arm and elongated upstream in the sheet feed direction and which engages with a side wall 57*a* of the feed frame 57.

Figure 6A:
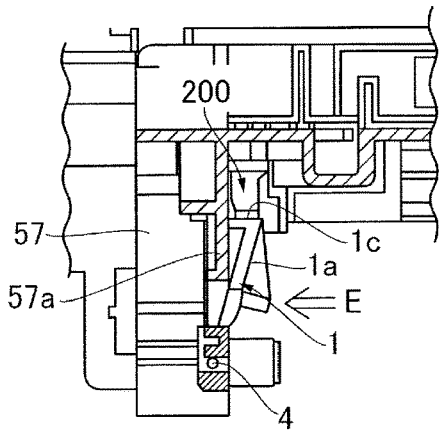
FIG. 6A is a side view illustrating the second holding member.

The body portion 1*a* has a hook-like holding hook portion 1*c* formed on the upper end of the body portion 1*a*. As illustrated in FIGS. 5A and 6A, the holding hook portion 1*c* protrudes from the side wall 57*a* of the feed frame 57 due to a resin spring property by the arm portion 1*b*. In addition, the second holding member 1 is positioned at a position illustrated in FIG. 6A, by a rotation stopper (not illustrated). Thus, when the body portion 1*a* is pushed downstream (direction indicated by an arrow E in FIG. 6A) in the attachment direction of the feed cassette 54, the second holding member 1 is retracted into the interior of the side wall 57*a*. In a state where the holding hook portion 1*c* protrudes from the side wall 57*a*, the holding hook portion 1*c* abuts from below against the abutment portion 202*d*, which is formed on the roller support mechanism 200 and protrudes from the same, and thus holds the roller support mechanism 200 at the separation position.

Figure 5B:
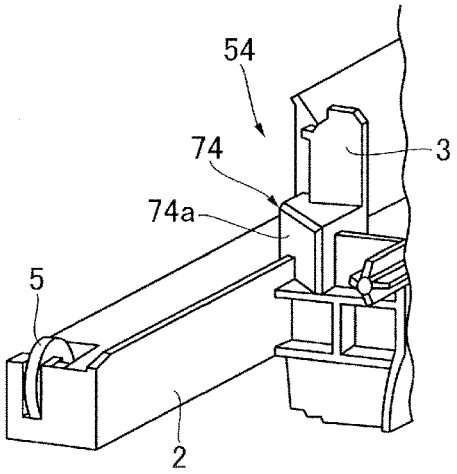
FIG. 5B is a perspective view illustrating a configuration of a vicinity of a guided portion of the feed cassette.

Next, a configuration on the feed cassette 54 side of the holding mechanism 30 will be described. FIG. 5B illustrates a portion of the feed cassette 54, located downstream in the attachment direction of the feed cassette and on one side (that is, the back side of a right portion of FIG. 1). The feed cassette 54 is configured to be attached to and drawn from the apparatus body 100*a* in the insertion-and-drawing direction, which is a front-back direction of FIG. 1. The feed cassette 54 is provided so as to be inserted into and drawn from the apparatus body 100*a*, and includes guided portions 2 on both right and left sides of the feed cassette 54. The guided portions 2 are guided by the guide rails 21 (see FIG. 6B). The guided portions 2 have guide rollers 5 disposed on top portions of the leading ends of the guided portions 2. The guide rollers 5 roll in the guide rails 21, and smooth the attachment/removal of the feed cassette 54 to/from the apparatus body 100*a*.

The feed cassette 54 is provided with a second release portion 3, which has a flat surface perpendicular to the attachment direction of the feed cassette 54. The second release portion 3 is used to push the second holding member 1 disposed on the apparatus body 100*a*, against the urging force of the second holding member 1. The second release portion 3 is formed to pivot the second holding member 1 toward a release direction and release the holding of the roller support mechanism 200 when the attachment of the feed cassette 54 to the apparatus body 100*a* is completed.

Furthermore, the feed cassette 54 is provided with a first release portion 74 which has a sloping surface 74*a*. The sloping surface 74*a* slidingly contacts the pressed portion 71*a* of the first holding member 71, and pivots the first holding member 71 toward the counterclockwise direction of FIG. 5A, against the elastic urging force of the tension coil spring 73 which is an elastic member. Since the insertion-and-removal direction of the feed cassette 54 and the pivot direction of the first holding member 71 are perpendicular to each other, the sloping surface 74*a* is sloping such that the sloping surface 74*a* is further upstream in the attachment direction as the sloping surface 74*a* extends downstream in the sheet feed direction. The sloping surface 74*a* of the first release portion 74, which serves as a pressing surface, pivots the first holding member 71 from the holding position toward the non-holding position, with the attachment operation of the feed cassette 54. The position of the first release portion 74 and the position the second release portion 3 of the feed cassette 54 are shifted from each other in the attachment direction of the feed cassette 54.

Operations of Feed Cassette and Holding Mechanism

Next, an operation of the holding mechanism 30 performed with the attachment and drawing operation of the feed cassette 54 will be described in detail. First, in a state where the feed cassette 54 is drawn from the apparatus body 100*a*, the first holding member 71 does not touch the first release portion 74 of the feed cassette 54. In this time, the first holding member 71 is positioned at the holding position by the tension coil spring 73 urging the first holding member 71, as illustrated in FIG. 5A. In addition, the upper edge portion 71*b* of the first holding member 71 is pushing up the abutment portion 202*d* of the roller support mechanism 200 against the urging force of the feed pressure spring 60, and thus the first holding member 71 holds the roller support mechanism 200 at the separation position. In this time, the pickup roller 51 is positioned at the standby position at which the pickup roller 51 does not touch the feed cassette 54 and the sheet stored in the feed cassette 54.

Also, the second holding member 1 does not touch the second release portion 3 of the feed cassette 54, and the holding hook portion 1*c* protrudes downstream in the drawing direction, from the side wall 57*a* of the feed frame 57, due to the resin spring property by the arm portion 1*b*, as illustrated in FIGS. 5A and 6A. When a user tries to attach the feed cassette 54 to the apparatus body 100*a*, the sloping surface 74*a* of the first release portion 74 first abuts against the pressed portion 71*a* of the first holding member 71. Then, the sloping surface 74*a* pivots the first holding member 71 from the holding position toward the non-holding position against the urging force of the tension coil spring 73, with the attachment operation of the feed cassette 54.

Figure 6B:
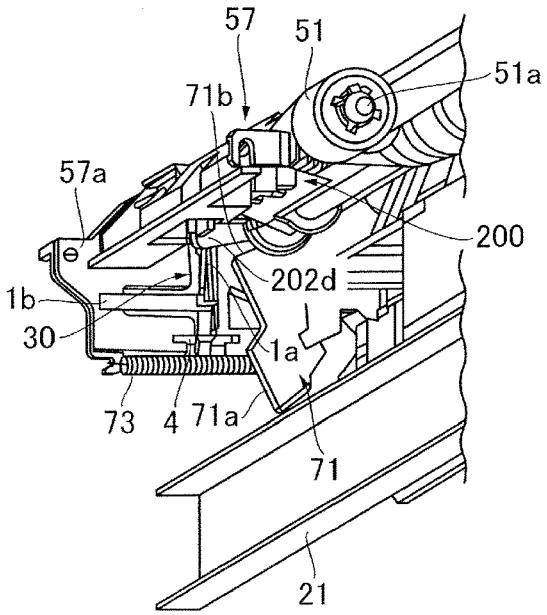
FIG. 6B is a perspective view illustrating the first holding member and the second holding member.

With this operation, the first holding member 71 is positioned at the non-holding position as illustrated in FIG. 6B, but the second release portion 3 of the feed cassette 54 still does not touch the second holding member 1 in this time. Thus, although the holding of the roller support mechanism 200 by the first holding member 71 is released, the roller support mechanism 200 remains held at the separation position by the second holding member 1. In this time, the upper edge portion 71*b* of the first holding member 71 is separated from the abutment portion 202*d* of the roller support mechanism 200.

Figure 7A:
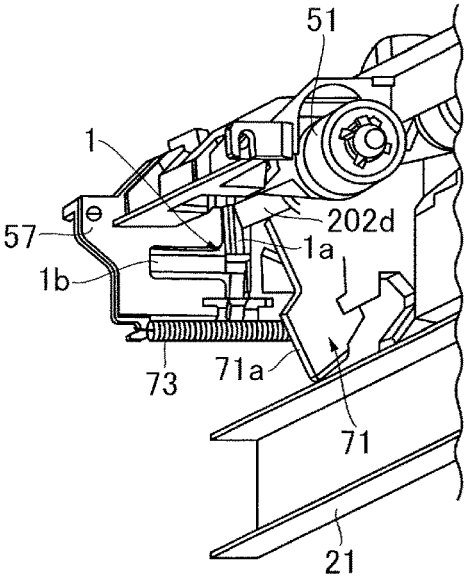
FIG. 7A is a perspective view illustrating the first holding member in a state where the pickup roller is positioned at a feed position.
Figure 7B:
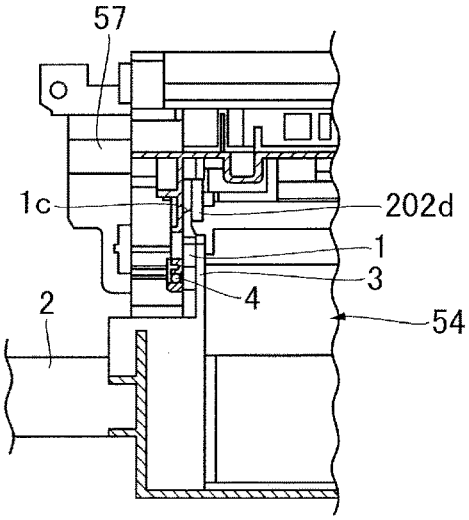
FIG. 7B is a side view illustrating the second holding member.

When the user further pushes the feed cassette 54 toward the apparatus body 100*a*, the second release portion 3 abuts against the body portion 1*a* of the second holding member 1, and pushes the body portion 1*a* toward the direction indicated by the arrow E in FIG. 6A. Then, when the feed cassette 54 abuts against the stopper 90 (see FIG. 2) and is positioned at the attachment position, the second holding member 1 is retracted into the interior of the side wall 57*a* as illustrated in FIG. 7B, and the holding of the roller support mechanism 200 by the holding hook portion 1*c* is released. With this operation, the holding of the roller support mechanism 200 by the first holding member 71 and the second holding member 1 is released as illustrated in FIG. 7A, and the roller support mechanism 200 is swung to the feed position by the urging force of the feed pressure spring 60.

Next, an operation of the holding mechanism 30 performed when the feed cassette 54 is drawn from the apparatus body 100*a* will be described. In a state where the feed cassette 54 is attached to the apparatus body 100*a*, the holding hook portion 1*c* of the second holding member 1 is in contact with a side surface of the abutment portion 202*d* of the roller support mechanism 200, and the second holding member 1 is stored in the side wall 57*a*. When the feed cassette 54 is drawn from the apparatus body 100*a* by a user, the first holding member 71 is pivoted along the sloping surface 74*a* of the first release portion 74 toward the direction indicated by the arrow Y in FIG. 5A, by the urging force of the tension coil spring 73. With this operation, the upper edge portion 71*b* of the first holding member 71 pushes up the abutment portion 202*d* of the roller support mechanism 200 from below. Here, the urging force of the tension coil spring 73 is larger than that of the feed pressure spring 60.

When the upper edge portion 71*b* of the first holding member 71 pushes up the abutment portion 202*d* of the roller support mechanism 200 to the holding position, the holding hook portion 1*c* of the second holding member 1 moves to a space located below the abutment portion 202*d* of the roller support mechanism 200. With this operation, the roller support mechanism 200 is held at the separation position by the first holding member 71 and the second holding member 1, and the pickup roller 51 can be held at the standby position. Thus, the first holding member 71 has a function that pushes up the roller support mechanism 200 to move the roller support mechanism 200 to the separation position, and to move the pickup roller 51 to the standby position. The second holding member 1 has a function that releases the holding of the roller support mechanism 200 when the feed cassette 54 is positioned at the attachment position as illustrated in FIG. 7B, and thereby causes the pickup roller 51 to move down to the feed position.

Roller Support Mechanism

Figure 8A:
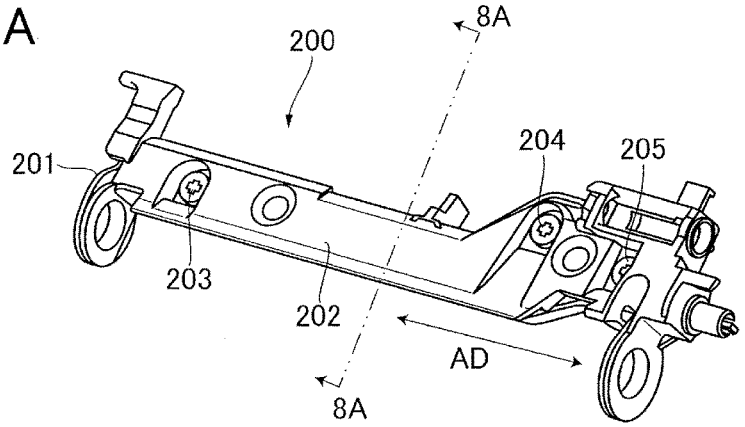
FIG. 8A is a perspective view illustrating the roller support mechanism.
Figure 8B:
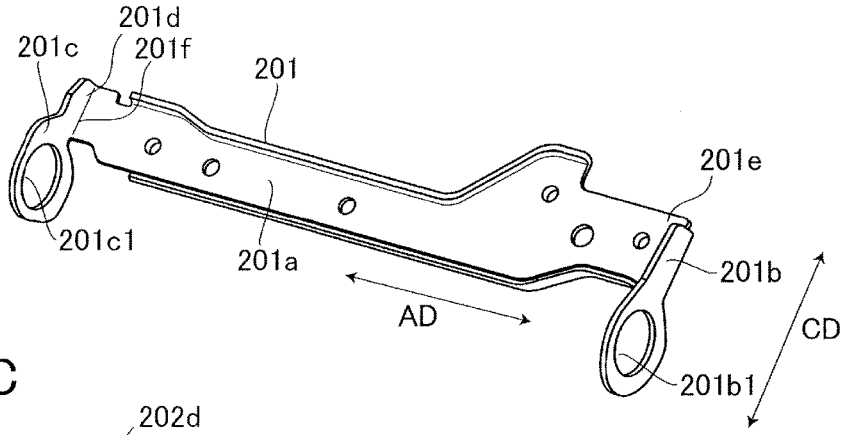
FIG. 8B is a perspective view illustrating a roller support frame.
Figure 8C:
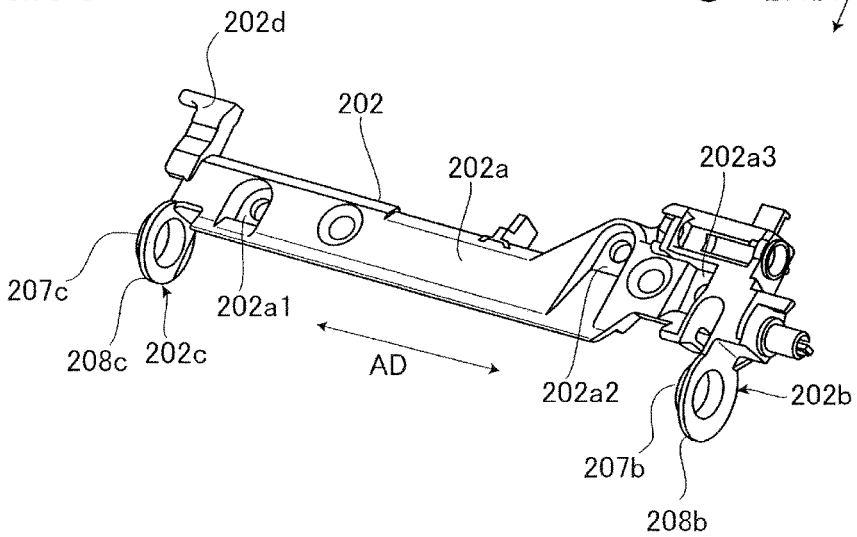
FIG. 8C is a perspective view illustrating a roller support guide.
Figure 10A:
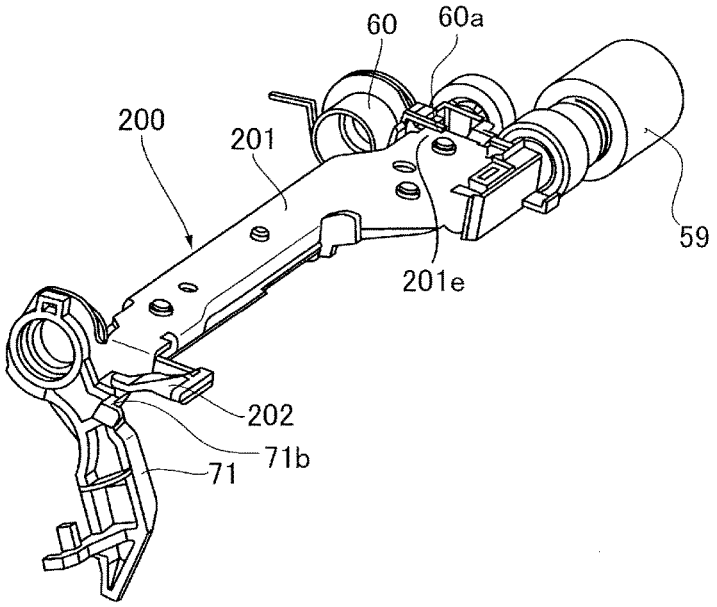
FIG. 10A is a perspective view illustrating the roller support mechanism.
Figure 10B:
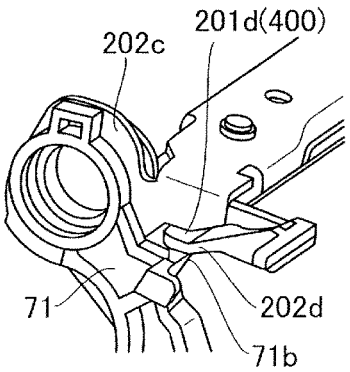
FIG. 10B is a partially enlarged view illustrating a contact portion between the first holding member and the roller support mechanism.
Figure 10C:
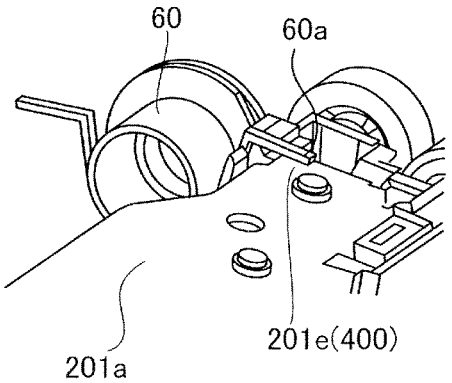
FIG. 10C is a partially enlarged view illustrating an abutment portion between the feed pressure spring and the roller support frame.

FIG. 8A is a perspective view illustrating a state where a roller support frame 201 and a roller support guide 202, which constitute the roller support mechanism 200, are combined with each other. FIG. 8B is a perspective view illustrating the roller support frame 201. FIG. 8C is a perspective view illustrating the roller support guide 202. FIG. 10A is a perspective view illustrating the roller support mechanism 200 positioned at the separation position. FIG. 10B is a partially enlarged view illustrating a contact portion between the first holding member 71 and the roller support mechanism 200. FIG. 10C is a partially enlarged view illustrating an abutment portion between the feed pressure spring 60 and the roller support frame 201.

As illustrated in FIG. 8A, the roller support mechanism 200 includes the roller support frame 201 constituted by a metal plate made of a metal material, and the roller support guide 202 made of a resin material having a high sliding property. The roller support guide 202 serving as a resin member has a first stiffness, and the roller support frame 201 serving as a metal member has a second stiffness higher than the first stiffness. The roller support frame 201 and the roller support guide 202 are fastened to each other with a plurality of screws 203 to 205.

As illustrated in FIG. 8B, the roller support frame 201 includes a screw fastened surface 201*a*, to which the screws 203 to 205 are fastened and which serves as a body portion, and pivot supporting surfaces 201*b* and 201*c* which are formed on both ends of the screw fastened surface 201*a* and which extend perpendicular to the screw fastened surface 201*a*. That is, the screw fastened surface 201*a* extends in an axial direction AD of the feed driving shaft 59. The pivot supporting surface 201*b*, which serves as a first bearing holding portion, extends from a first end portion 201*e*, in the axial direction AD, of the screw fastened surface 201*a* towards a cross direction CD which crosses the axial direction AD. The pivot supporting surface 201*c*, which serves as a second bearing holding portion, extends from a second end portion 201*f* of the screw fastened surface 201*a* toward the cross direction CD. The pivot supporting surfaces 201*b* and 201*c* respectively have through-holes 201*b*1 and 201*c*1, through which the feed driving shaft 59 passes.

As illustrated in FIG. 8C, the roller support guide 202 includes a guide surface 202*a*, which extends in the axial direction AD of the feed driving shaft 59 and guides the sheet S fed by the pickup roller 51. The roller support guide 202 also includes bearing portions 202*b* and 202*c* formed at both ends of the guide surface 202*a*. The bearing portion 202*b* is interposed between the through-hole 201*b*1 of the roller support frame 201 and the feed driving shaft 59 and slidingly supports the feed driving shaft 59, the bearing portion 202*c* is interposed between the through-hole 201*c*1 of the roller support frame 201 and the feed driving shaft 59 and slidingly supports on the feed driving shaft 59. The bearing portions 202*b* and 202*c*, which serves as a first bearing portion and a second bearing portion, are disposed at different positions in the axial direction AD, and supported by the pivot supporting surfaces 201*b* and 201*c*, respectively. The guide surface 202*a* and the bearing portions 202*b* and 202*c* are formed of a resin material as a one piece. The guide surface 202*a* has screw fastened portions 202*a*1 to 202*a*3, to which the screws 203 to 205 are fastened. The screw fastened portions 202*a*1 to 202*a*3 are concaved with respect to the guide surface 202*a* so that the sheet S is not caught.

Figure 9:
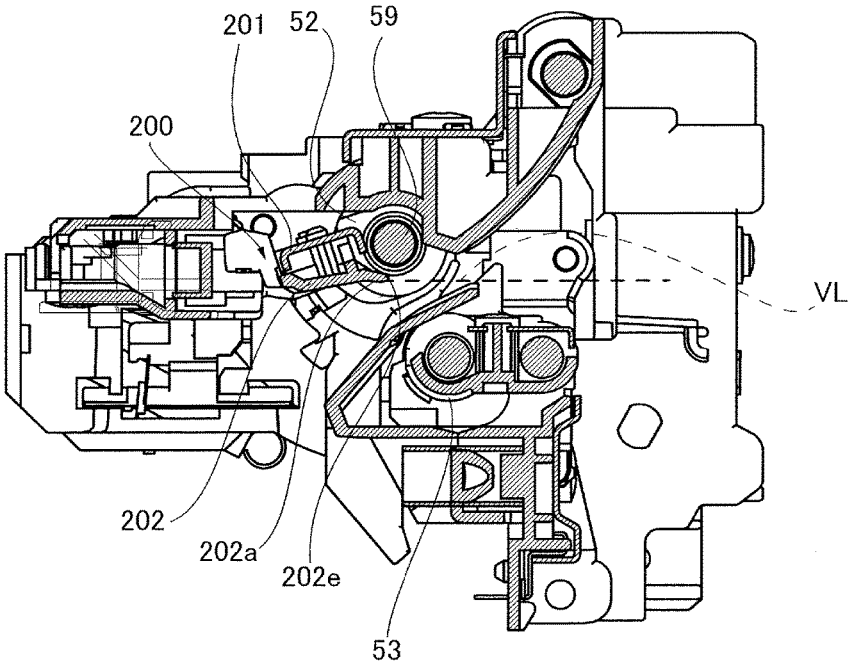
FIG. 9 is a cross-sectional view taken along a line 8A-8A of FIG. 8A.

FIG. 9 is a cross-sectional view illustrating an 8A-8A cross section which is perpendicular to the axial direction AD of FIG. 8A. As illustrated in FIG. 9, the guide surface 202*a* of the roller support guide 202 is disposed below the feed driving shaft 59, and partly overlapped with the feed driving shaft 59 in the sheet feed direction. In addition, if an imaginary line VL is drawn so as to extend from a downstream edge portion 202*e*, in the sheet feed direction, of the guide surface 202*a*, the imaginary line VL lies below the feed driving shaft 59. With the guide surface 202*a* formed in this manner, even when a curled sheet by the pickup roller 51 is fed, the sheet can be prevented from touching the feed driving shaft 59. With this configuration, the sheet can be prevented from entering a space between the guide surface 202*a* and the feed driving shaft 59, and thus from being jammed.

If such guide surface 202*a* is made of a metal material, the cost will increase, partly because the guide surface 202*a* has a complex shape. In contrast, a resin material can achieve a desired shape, with less cost than the metal material. Thus, in the present embodiment, a problem in which the roller support mechanism 200 is deformed is resolved by the roller support frame 201 made of a metal material, and a problem in which the sheet is not properly guided is resolved by the roller support guide 202 made of a resin material.

As illustrated in FIG. 8C, one end portion of the guide surface 202*a* is provided with the abutment portion 202*d*, which is disposed out of a sheet conveyance area and can abut against the upper edge portion 71*b* of the first holding member 71. The sheet conveyance area is a space through which the sheet fed by the pickup roller 51 passes. As illustrated in FIG. 4A, the first holding member 71, which abuts against the abutment portion 202*d*, is also disposed out of the sheet conveyance area in the axial direction AD of the feed driving shaft 59. On the other hand, the pickup roller 51 is disposed at a substantially center portion of the sheet conveyance area in the axial direction AD of the feed driving shaft 59. The feed pressure spring 60 is disposed in the vicinity of the pickup roller 51.

The bearing portions 202*b* and 202*c*, respectively, have collar portions 207*b* and 207*c* which are inserted into the through-holes 201*b*1 and 201*c*1, and flange portions 208*b* and 208*c* which extend radially along the pivot supporting surfaces 201*b* and 201*c*. With the collar portions 207*b* and 207*c* and the flange portions 208*b* and 208*c*, the roller support guide 202 can be easily positioned with respect to the roller support frame 201.

As illustrated in FIGS. 10A and 10B, in a state where the roller support mechanism 200 is positioned at the separation position, the upper edge portion 71*b* of the first holding member 71 abuts against the abutment portion 202*d* of the roller support guide 202, from the downward direction, and is in contact with the abutment portion 202*d*. In addition, the abutment portion 202*d* is in contact with an end portion 201*d* of the pivot supporting surface 201*c* of the roller support frame 201, on a side of the abutment portion 202*d* opposite to the upper edge portion 71*b*. With this configuration, a force from the first holding member 71 which is urged upward by the tension coil spring 73 can be received by the end portion 201*d* of the roller support frame 201, which serves as a contact portion, via the abutment portion 202*d*. That is, the end portion 201*d* is in contact with a first surface, of the abutment portion 202*d*, opposite to a second surface on which the upper edge portion 71*b* presses the abutment portion 202*d* in the swing direction of the roller support mechanism 200.

In addition, as illustrated in FIG. 10C, one end portion 60*a* of the feed pressure spring 60 is supported on the first end portion 201*e* of the screw fastened surface 201*a* of the roller support frame 201. With this configuration, the urging force of the feed pressure spring 60 can be received by the roller support frame 201. The end portion 201*d* of the pivot supporting surface 201*c* and the first end portion 201*e* of the screw fastened surface 201*a* constitute a receiving portion 400, and are disposed separately at one end side and the other end side of the roller support frame 201 in the axial direction of the feed driving shaft 59. Since a direction in which the end portion 201*d* receives one force and a direction in which the first end portion 201*e* receives another force are substantially opposite to each other, torsional stress occurs in the roller support frame 201.

As described above, in the present embodiment, the roller support mechanism 200 is constituted by the roller support frame 201 formed of a metal material having a high stiffness, and the roller support guide 202 formed of a resin material having a high sliding property. Since the roller support frame 201 receives the urging force of the feed pressure spring 60 and the urging force of the tension coil spring 73, and the roller support guide 202 slidingly contacts with the sheet S and the feed driving shaft 59, torsional stress occurs in the roller support frame 201. However, the deformation of the roller support mechanism 200 can be reduced because the roller support frame 201 is made of a metal material having a high stiffness. Furthermore, the sheet feeding apparatus 6 needs not to be designed larger in consideration of the deformation of the roller support mechanism 200, and thus the sheet feeding apparatus 6 can be prevented from being designed larger. In addition, the roller support guide 202 having a high sliding property enables better sliding properties for the sheet S and the feed driving shaft 59.

The roller support frame 201 and the roller support guide 202 are fixed to each other via the screws in the present embodiment, but the present disclosure is not limited to this. In addition, the holes 201*b*1 and 201*c*1 on which the roller support mechanism 200 pivots are formed in a circular shape in the figures, but the present disclosure is not limited to the circular shape as long as the holes are formed so that the bearing portions 202*b* and 202*c* of the roller support guide 202 fit the holes. For example, the holes may be formed so as to have two parallel planes.

In addition, although the upper edge portion 71*b* of the first holding member 71 abuts against the abutment portion 202*d* of the roller support guide 202, the upper edge portion 71*b* may directly contact the end portion 201*d* of the pivot supporting surface 201*c* of the roller support frame 201. Similarly, the holding hook portion 1*c* of the second holding member 1 may directly contact the end portion 201*d* of the pivot supporting surface 201*c* of the roller support frame 201. Regarding the feed pressure spring 60, although the one end portion 60*a* contacts the roller support frame 201 for urging, the one end portion 60*a* may not necessarily contact the roller support frame 201 as long as the roller support frame 201 receives the urging force.

Second Embodiment

Next, a second embodiment of the present invention will be described. The second embodiment is configured such that the roller support mechanism 200 of the first embodiment is achieved by another configuration. Thus, the same components as those of the first embodiment are omitted in the drawings, or described with the same symbols given to the drawings.

Figure 11A:
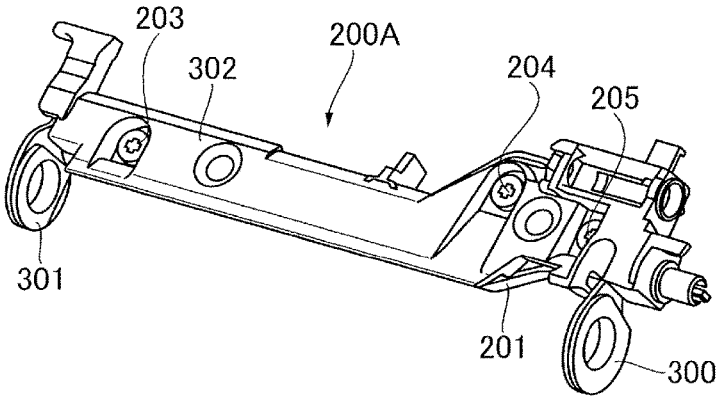
FIG. 11A is a perspective view illustrating a roller support mechanism of a second embodiment.
Figure 11B:
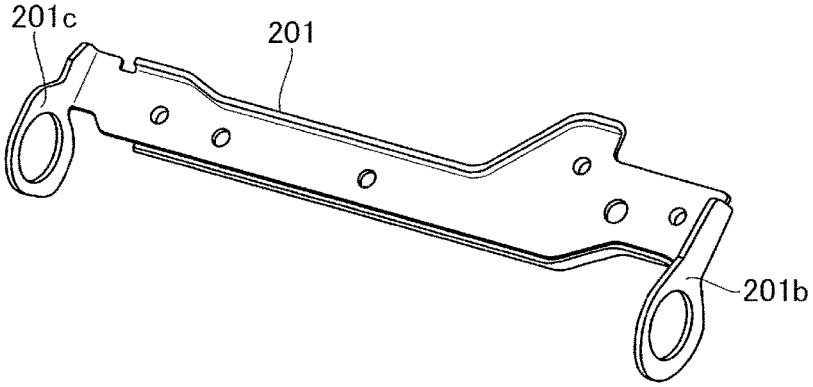
FIG. 11B is a perspective view illustrating the roller support frame.
Figure 11C:
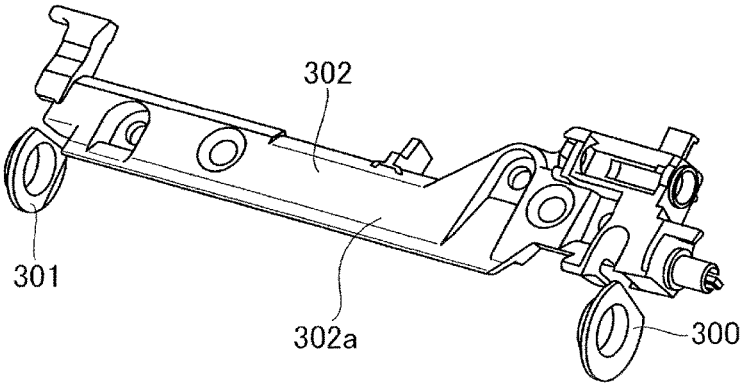
FIG. 11C is a perspective view illustrating a guide portion and bearings.

FIG. 11B is a perspective view illustrating the roller support frame 201. FIG. 11C is a perspective view illustrating bearings 300 and 301, and a guide portion 302. FIG. 11A is a perspective view illustrating a roller support mechanism 200A in which the roller support frame 201, the bearings 300 and 301, and the guide portion 302 are combined with each other. As illustrated in FIG. 11A, the roller support mechanism 200A, which serves as a swing unit, includes the roller support frame 201, the guide portion 302 which is a resin member, and the bearings 300 and 301 which serve as the first bearing portion and the second shaft bearing portion. The roller support frame 201 is the same as that of the first embodiment, and thus the description thereof is omitted. The guide portion 302 and the bearings 300 and 301 are made of a resin material having a high sliding property and have a first stiffness, and the roller support frame 201 has a second stiffness higher than the first stiffness. The guide portion 302 is fixed to the roller support frame 201 with the plurality of screws 203, 204, and 205, and has a guide surface 302*a* which guides the sheet S fed by the pickup roller 51.

The bearings 300 and 301 are formed separately from the guide portion 302. The bearing 300 is interposed between the pivot supporting surface 201*b* of the roller support frame 201 and the feed driving shaft 59; the bearing 301 is interposed between the pivot supporting surface 201*c* of the roller support frame 201 and the feed driving shaft 59. The bearings 300 and 301 are formed, for example, so as to have one plane or two parallel planes, and formed integrally with the pivot supporting surfaces 201*b* and 201*c* of the roller support frame 201. Also in the second embodiment, the same effects as those of the first embodiment can be obtained.

The bearings 300 and 301 may have any material other than the resin material and may be other bearings such as sintered bearings or ball rolling bearings, as long as the other bearings function as the bearings.

Also, although the description is made using the electrophotographic printer 100 in any of the embodiments describe above, the present invention is not limited to this. For example, the present invention may also be applied to an ink-jet image forming apparatus that forms images on sheets by injecting ink from its nozzle.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-250093, filed Dec. 22, 2016, and Japanese Patent Application No. 2017-208373, filed Oct. 27, 2017, which are hereby incorporated by reference wherein in their entirety.

What is claimed is:

1. A sheet feeding apparatus comprising:

a sheet supporting portion configured to support a sheet;

a feeding portion configured to feed the sheet supported by the sheet supporting portion;

a swing unit configured to swingably support the feeding portion between a feed position and a separation position, the feed position being a position at which the feeding portion abuts against the sheet supported by the sheet supporting portion and feed the sheet, the separation position being a position at which the feeding portion is separated from the sheet supported by the sheet supporting portion;

a swing shaft configured to swingably support the swing unit;

an urging portion configured to contact with the swing unit at a first position so as to urge the swing unit toward the feed position; and a holding portion configured to contact with the swing unit at a second position so as to hold the swing unit at the separation position against an urging force of the urging portion, the second position being different from the first position in an axial direction of the swing shaft, wherein the swing unit comprises:

a first bearing portion configured to slidingly support the swing shaft;

a second bearing portion disposed offset to the first bearing portion and configured to slidingly support the swing shaft;

a metal member configured to hold the first bearing portion and the second bearing portion; and a resin member having a guide surface configured to guide the sheet fed by the feeding portion, wherein the metal member comprises:

a body portion which extends in the axial direction and to which the resin member is attached;

a first bearing holding portion that extends from a first end portion, in the axial direction, of the body portion toward a cross direction which crosses the axial direction and that holds the first bearing portion; and a second bearing holding portion that extends from a second end portion, in the axial direction, of the body portion toward the cross direction and that holds the second bearing portion.

2. An image forming apparatus comprising:

the sheet feeding apparatus according to claim 1; and an image forming portion configured to form an image on a sheet fed by the sheet feeding apparatus.

3. A sheet feeding apparatus comprising:

a sheet supporting portion configured to support a sheet;

a feeding portion configured to feed the sheet supported by the sheet supporting portion;

a swing unit configured to swingably support the feeding portion between a feed position and a separation position, the feed position being a position at which the feeding portion abuts against the sheet supported by the sheet supporting portion and feed the sheet, the separation position being a position at which the feeding portion is separated from the sheet supported by the sheet supporting portion;

a swing shaft configured to swingably support the swing unit;

an urging portion configured to contact with the swing unit at a first position so as to urge the swing unit toward the feed position; and a holding portion configured to contact with the swing unit at a second position so as to hold the swing unit at the separation position against an urging force of the urging portion, the second position being different from the first position in an axial direction of the swing shaft, wherein the swing unit comprises:

a first bearing portion configured to slidingly support the swing shaft;

a second bearing portion disposed offset to the first bearing portion and configured to slidingly support the swing shaft;

a metal member configured to hold the first bearing portion and the second bearing portion; and a resin member having a guide surface configured to guide the sheet fed by the feeding portion, wherein the metal member receives the urging force of the urging portion and a force from the holding portion at positions different from each other in the axial direction, wherein the resin member comprises an abutment portion configured to abut against the holding portion, wherein the holding portion comprises a pressing portion configured to press the abutment portion against the urging force of the urging portion, and wherein the metal member comprises a contact portion that is in contact with a first surface, of the abutment portion, opposite to a second surface of the abutment portion in a swing direction of the swing unit, the second surface being pressed by the pressing portion.

4. The sheet feeding apparatus according to claim 3, wherein the contact portion is disposed on a first side of the metal member in the axial direction, and wherein the metal member supports the urging portion on a second side, of the metal member, opposite to the first side in the axial direction.

5. An image forming apparatus comprising:

the sheet feeding apparatus according to claim 3; and an image forming portion configured to form an image on a sheet fed by the sheet feeding apparatus.

6. The sheet feeding apparatus according to claim 1, comprising:

a sheet supporting portion configured to support a sheet;

a feeding portion configured to feed the sheet supported by the sheet supporting portion;

a swing unit configured to swingably support the feeding portion between a feed position and a separation position, the feed position being a position at which the feeding portion abuts against the sheet supported by the sheet supporting portion and feed the sheet, the separation position being a position at which the feeding portion is separated from the sheet supported by the sheet supporting portion;

a swing shaft configured to swingably support the swing unit;

an urging portion configured to contact with the swing unit at a first position so as to urge the swing unit toward the feed position; and a holding portion configured to contact with the swing unit at a second position so as to hold the swing unit at the separation position against an urging force of the urging portion, the second position being different from the first position in an axial direction of the swing shaft, wherein the swing unit comprises:

a first bearing portion configured to slidingly support the swing shaft;

a second bearing portion disposed offset to the first bearing portion and configured to slidingly support the swing shaft;

a metal member configured to hold the first bearing portion and the second bearing portion; and a resin member having a guide surface configured to guide the sheet fed by the feeding portion, and wherein the first bearing portion, the second bearing portion, and the resin member are formed of a resin material as a one piece.

7. An image forming apparatus comprising:

the sheet feeding apparatus according to claim 6; and an image forming portion configured to form an image on a sheet fed by the sheet feeding apparatus.

8. The sheet feeding apparatus comprising:

a sheet supporting portion configured to support a sheet;

a feeding portion configured to feed the sheet supported by the sheet supporting portion;

a swing unit configured to swingably support the feeding portion between a feed position and a separation position, the feed position being a position at which the feeding portion abuts against the sheet supported by the sheet supporting portion and feed the sheet, the separation position being a position at which the feeding portion is separated from the sheet supported by the sheet supporting portion;

a swing shaft configured to swingably support the swing unit;

a first urging portion configured to contact with the swing unit at a first position so as to urge the swing unit toward the feed position;

a second urging portion; and a holding portion configured to contact with the swing unit at a second position so as to hold the swing unit at the separation position against an urging force of the first urging portion, the second position being different from the first position in an axial direction of the swing shaft, wherein the swing unit comprises:

a first bearing portion configured to slidingly support the swing shaft;

a second bearing portion disposed offset to the first bearing portion and configured to slidingly support the swing shaft;

a metal member configured to hold the first bearing portion and the second bearing portion; and a resin member having a guide surface configured to guide the sheet fed by the feeding portion, wherein the holding portion is configured to move between a holding position and a non-holding position, the holding position being a position at which the holding portion holds the swing unit at the separation position, the non-holding position being a position at which the holding portion is separated from the swing unit and does not hold the swing unit, and wherein the second urging portion is configured to urge the holding portion toward the holding position.

9. The sheet feeding apparatus according to claim 8, wherein the metal member receives the urging force of the first urging portion and a force from the holding portion at positions different from each other in the axial direction.

10. The sheet feeding apparatus according to claim 9, the metal member is configured to abut against the first urging portion.

11. The sheet feeding apparatus according to claim 8, wherein the guide surface is disposed below the swing shaft, and wherein at least a part of the guide surface overlaps with the swing shaft in a sheet feed direction.

12. The sheet feeding apparatus according to claim 8, wherein an imaginary line which extends from a downstream edge portion, in a sheet feed direction, of the guide surface lies below the swing shaft.

13. The sheet feeding apparatus according to claim 8, wherein the first bearing portion and the second bearing portion are formed of a resin material.

14. The sheet feeding apparatus according to claim 8, further comprising:

an apparatus body configured to rotatably support the swing shaft; and a drawer portion configured to hold the sheet supporting portion, and configured to be attached to and drawn from the apparatus body, wherein the drawer portion comprises a pressing surface configured to press the holding portion with an attachment operation of the drawer portion, from the holding position to the non-holding position against the urging force of the second urging portion.

15. The sheet feeding apparatus according to claim 14, wherein an urging force of the second urging portion is larger than that of the first urging portion, and wherein the swing unit is moved to the separation position by the urging force of the second urging portion in a case where the drawer portion is drawn from the apparatus body.

16. The sheet feeding apparatus according to claim 14, further comprising a second holding portion, wherein the holding portion is a first holding portion which is configured to move from the holding position to the non-holding position in a case where the drawer portion is being attached to the apparatus body, and the second holding portion is configured to hold the swing unit at the separation position and release holding of the swing unit in a case where the drawer portion is attached to the apparatus body.

17. The sheet feeding apparatus according to claim 8, wherein the feeding portion is disposed in a vicinity of the first urging portion in the axial direction, and wherein the holding portion is disposed out of a conveyance area for the sheet conveyed by the feeding portion, in the axial direction.

18. The sheet feeding apparatus according to claim 8, further comprising a feed roller attached to the swing shaft and configured to convey the sheet fed by the feeding portion.

19. An image forming apparatus comprising:

the sheet feeding apparatus according to claim 8; and an image forming portion configured to form an image on a sheet fed by the sheet feeding apparatus.

* * * * *